US010888208B2

(12) United States Patent
Barbisch et al.

(10) Patent No.: US 10,888,208 B2
(45) Date of Patent: Jan. 12, 2021

(54) SUPPLY DEVICE FOR A CLEANING MACHINE WHICH CAN BE CONNECTED VIA AT LEAST ONE FLEXIBLE HOSE

(71) Applicant: SWISSLOGO AG, Niederglatt (CH)

(72) Inventors: Helmut Barbisch, Meiningen (AT); Michael Keith Ching, Stadl (CH)

(73) Assignee: SWISSLOGO AC, Niederglatt (CH)

( * ) Notice: Subject to any disclaimer, the term of this patent is extended or adjusted under 35 U.S.C. 154(b) by 418 days.

(21) Appl. No.: 15/984,842

(22) Filed: May 21, 2018

(65) Prior Publication Data

US 2018/0263452 A1 Sep. 20, 2018

Related U.S. Application Data

(63) Continuation of application No. PCT/EP2016/078182, filed on Nov. 18, 2016.

(30) Foreign Application Priority Data

Nov. 20, 2015 (AT) ..... A 751/2015

(51) Int. Cl.

| | |
|---|---|
| ***A47L 11/20*** | (2006.01) |
| ***A47L 11/30*** | (2006.01) |
| ***A47L 11/40*** | (2006.01) |
| ***A47L 11/34*** | (2006.01) |
| ***A47L 9/24*** | (2006.01) |

(52) U.S. Cl.

CPC ..... *A47L 11/201* (2013.01); *A47L 9/24* (2013.01); *A47L 11/30* (2013.01); *A47L 11/305* (2013.01); *A47L 11/34* (2013.01); *A47L 11/4016* (2013.01); *A47L 11/4072* (2013.01); *A47L 11/4083* (2013.01); *A47L 11/4086* (2013.01); *A47L 11/4088* (2013.01)

(58) Field of Classification Search

CPC ..... A47L 11/34; A47L 11/4086

See application file for complete search history.

(56) References Cited

U.S. PATENT DOCUMENTS

| | | | |
|---|---|---|---|
| 3,821,830 | A | 7/1974 | Sundheim |
| 4,019,218 | A | 4/1977 | Cyphert |
| 4,974,618 | A | 12/1990 | Nysted |

(Continued)

FOREIGN PATENT DOCUMENTS

| | | | |
|---|---|---|---|
| DE | 2712840 | A1 | 10/1977 |
| DE | 9216531 | U1 | 5/1993 |

(Continued)

*Primary Examiner* — Andrew A Horton

(74) *Attorney, Agent, or Firm* — Laurence A. Greenberg; Werner H. Stemer; Ralph E. Locher

(57) ABSTRACT

A supply unit for a cleaning machine which can be connected via at least one flexible hose, has a heating device for heating water, a water pump for conveying water into or out of the heating device, a hot water and/or steam connector which is connected to the outlet of the heating device, a dirty water tank, a suction device, which preferably includes a suction turbine, for sucking dirty water from a dirty water connector into the dirty water tank. In a preferred embodiment the unit has at least one, preferably precisely one central, drive unit for driving at least one, preferably a plurality of or all components to be driven of the supply unit and/or of a cleaning machine to be connected to it.

12 Claims, 4 Drawing Sheets

(56) References Cited

U.S. PATENT DOCUMENTS

| | | | | |
|---|---|---|---|---|
| 8,051,527 | B2 | 11/2011 | Lee | |
| 2007/0186370 | A1* | 8/2007 | Oh | A47L 5/225 15/321 |

FOREIGN PATENT DOCUMENTS

| | | | |
|---|---|---|---|
| EP | 1498063 | A1 | 1/2005 |
| JP | 2002143064 | A | 5/2002 |
| WO | 2004017805 | A1 | 3/2004 |
| WO | 2007117095 | A1 | 10/2007 |

* cited by examiner

SUPPLY DEVICE FOR A CLEANING MACHINE WHICH CAN BE CONNECTED VIA AT LEAST ONE FLEXIBLE HOSE

CROSS-REFERENCE TO RELATED APPLICATION

This application is a continuation, under 35 U.S.C. § 120, of copending international application No. PCT/EP2016/078182, filed Nov. 18, 2016, which designated the United States; this application also claims the priority, under 35 U.S.C. § 119, of Austrian patent application No. A751/2015, filed Nov. 20, 2015; the prior applications are herewith incorporated by reference in their entirety.

BACKGROUND OF THE INVENTION

Field of the Invention

The invention relates to a supply unit for a cleaning machine which can be connected via at least one flexible hose, and to a cleaning device having a cleaning machine of this type.

It is already known to use dry steam (superheated steam) and/or hot water to clean surfaces, for example of chewing gum contaminants. A supply unit provides steam or the heated water which can subsequently be fed via a flexible hose to the actual cleaning machine. The cleaning machine is usually handheld.

SUMMARY OF THE INVENTION

It is an object of the invention to provide a supply device for a cleaning machine and a cleaning machine which overcome a variety of disadvantages of the heretofore-known devices and methods of this general type with improved cleaning action and cleaning functionality.

With the foregoing and other objects in view there is provided, in accordance with the invention, a supply unit for a cleaning machine to be connected to the supply unit via at least one flexible hose, the supply unit comprising:

a heating device for heating water, said heating device having an outlet;

a water pump for conveying water into or out of said heating device;

a hot water and/or steam connector in communication with said outlet of said heating device;

a dirty water tank; and a suction device for sucking dirty water from a dirty water connector into said dirty water tank.

In the case of a supply unit of this type, in addition to the provision of steam and/or hot water, an extraction of dirty water is also provided, it being possible for all the components to be assembled to form a compact structural unit. This allows autonomous operation.

With the above and other objects in view there is also provided, in accordance with the invention, a supply unit for a cleaning machine to be connected to the supply unit via at least one flexible hose, the supply unit comprising: a central drive unit and a plurality of components to be driven by the supply unit or a cleaning machine to be connected thereto. In this way, a space-saving construction which is optimized in terms of weight and is simple in terms of control technology is possible.

The components to be driven can be not only the components of the supply unit itself, for example a water pump for conveying water from the water tank to the heating device or the drive of the suction turbine of the suction device, but rather also components of a cleaning machine which can be connected to it. In other words, in the case of this variant, the otherwise autonomous drive is moved from the cleaning machine (in particular, completely) into the supply unit. In this way, the cleaning machine itself can manage without an energy source, for example a fuel tank or a battery, and movable components there, such as drive wheels or brushes, can nevertheless be driven.

Furthermore, one embodiment is particularly preferred, in the case of which the drives (preferably all the drives) are effected substantially hydraulically. To this end, a (central) drive motor, in particular a diesel internal combustion engine, is provided, the fuel tank of which is arranged in the supply unit. Said internal combustion engine then drives one or more hydraulic pumps, and the pressurized hydraulic fluid can then be used in multiple ways, for example in order to drive the propulsion drive of the supply unit, in order to drive the water pump, the suction turbine or the fan of the heating device, or in order to convey fuel from the fuel tank into the burner of the heating device.

The pressurized hydraulic fluid can likewise be used, via a flexible hydraulic line, to also drive movable components of the cleaning machine which is arranged via a flexible hose line.

In the case of one special embodiment, substantially three types of lines then lead therefore to the cleaning machine:

a hydraulic line for driving movable components, a superheated steam (dry steam)/hot water line toward the cleaning machine, and a suction line for extracting dirty water away from the cleaning machine back to the supply unit.

The invention is not restricted to an internal combustion engine as a central drive source. Other drives are also certainly conceivable and possible. Embodiments are particularly preferred, however, in the case of which the supply unit operates autonomously, that is to say does not require any further energy supply from the outside, but rather conversely provides its energy to the cleaning machines.

The term "flexible hose" or "line" is to be considered accordingly broadly. Said components serve not only to transport fluids, such as hot water, steam or pressurized hydraulic fluid and dirty water, but rather the term "flexible hose" or "line" is also to be considered in such a way that it comprises a multiple purpose hose, for example for feeding hydraulic fluid to the cleaning machine and for discharging hydraulic fluid from the cleaning machine. Furthermore, the term "flexible hose" or "line" is to be considered in such a way that electric lines also fall within said term.

Electric drives and drives using steam are also possible.

The cleaning machine is particularly suitable for removing contaminants, in particular chewing gum residues, on floor surfaces, in particular areas, streets and/or sidewalks which lie outdoors.

Other features which are considered as characteristic for the invention are set forth in the appended claims.

Although the invention is illustrated and described herein as embodied in a supply device for a cleaning machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
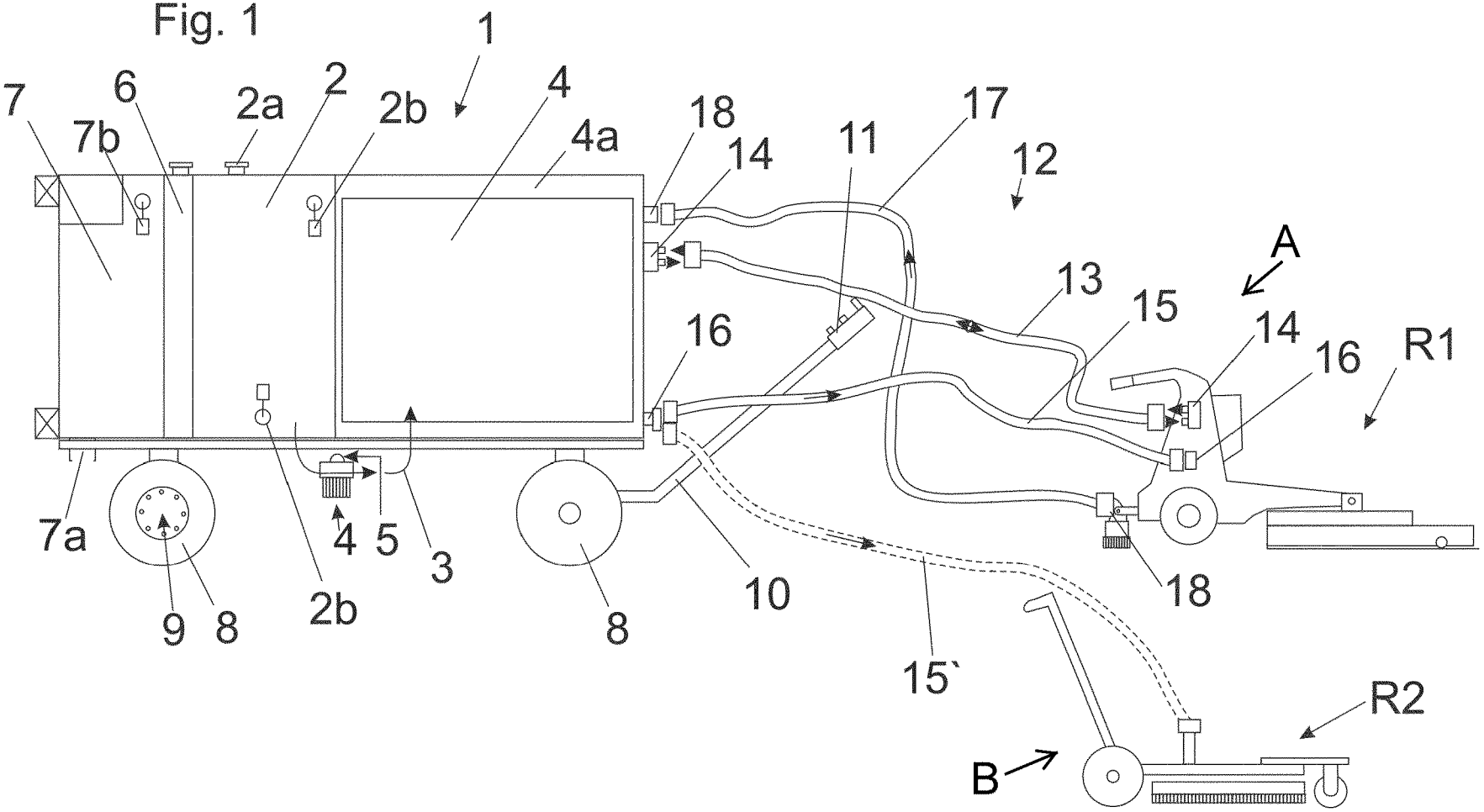
FIG. 1 shows a diagrammatic illustration of one exemplary embodiment of a supply unit according to the invention, with part A illustrating a first exemplary embodiment of a cleaning machine according to the invention, and part B illustrating a second exemplary embodiment of a cleaning machine according to the invention.

Referring now to the figures of the drawing in detail and first, particularly, to FIG. 1 thereof, there is shown a supply unit 1 that serves to supply cleaning machines R1, R2, as are shown as alternatives in parts A and B. The connection is effected via flexible hoses 12 which will be described in greater detail in the following text.

According to the invention, the supply unit itself has a water tank 2 for fresh water. The tank is of substantially cuboid configuration in a space-saving manner, and has a filler neck 2*a* and filling level sensors 2*b*.

A line 3 leads from the water tank 2 to a "power module 4" which will be described in greater detail in the following text with reference to FIG. 2.

A water filter 4 can be installed into the line 3. Descaling agent or else cleaning agent or other additives can be metered in via an additive line 5.

Furthermore, FIG. 1 shows a fuel tank for receiving fossil fuel, in particular diesel. The fuel tank 6 has a filler neck 6*a*. It is likewise of cuboid configuration in a space-saving manner.

Moreover, there is also a dirty water tank 7 with an outlet 7*a* which can be opened via a valve (not shown). The dirty water tank 7 has a filling level sensor 7*b*.

The entire supply unit has a self-propelled configuration. To this end, it has wheels 8. It is possible for the rear wheel pair 8 to be driven via a hydraulic motor.

The front wheels are steerable. A drawbar 10 renders it possible for the steering angle to be fixed. A control panel 11 is arranged on the drawbar 10, via which control panel 11 the essential components of the supply unit can be controlled.

The primarily important components of the supply unit (apart from the tanks) are combined to form one structural unit, the support frame being constructed from a plurality of supports which surround an interior space.

The supports can be configured from profiles, preferably hollow profiles with a rectangular cross section. Overall, the supports of the support frame 4*a* favorably extend along the sides of an imaginary cuboid. The entire support frame 4*a* including the components which are contained therein forms what is known as the "power module" which can also be moved separately from the tanks 2, 6 and 7 for assembly or service purposes.

Otherwise, the cleaning machines of parts a and B of FIG. 1 possibly also have control panels of this type, in order for it to be possible to control functions. The transmission of data can take place either by radio or via data lines.

The cleaning machine which is shown in part a of FIG. 1 will be described in greater detail later below with reference to FIG. 3. The following is to be mentioned for the overview illustrations of FIG. 1:

The cleaning machine in accordance with part A of FIG. 1 is supplied with a wide variety of fluids via flexible hoses 12 by the supply unit.

First of all, a flexible hose 13 is provided which is configured as a double hydraulic hose and can be connected releasably via connectors 14 (plug-in couplings) to the supply unit 1 and the cleaning machine in accordance with FIG. 1. The pressurized hydraulic fluid which is conducted therein serves to drive movable components, in particular brushes, as will be described more precisely later using FIG. 3.

Furthermore, a flexible hose 15 is provided which serves to feed hot water or steam from the supply unit to the cleaning machine in accordance with part A of FIG. 1. The connections can likewise take place via releasable plug-in couplings 16.

Finally, there is also a dirty water hose 17 which can be connected releasably via plug-in couplings 18. The dirty water hose 17 serves to discharge dirty water toward the supply unit.

Not only one type of cleaning machine can be connected to the mobile supply unit in accordance with FIG. 1, however. Other types can also be connected, for example the type of part B of FIG. 1 which serves specifically for weed control and is of simpler configuration than that cleaning machine from part A. It namely does not have any hydraulically driven components or a dirty water discharge, but rather merely a feed line 15' for superheated steam/dry steam.

Figure 2:
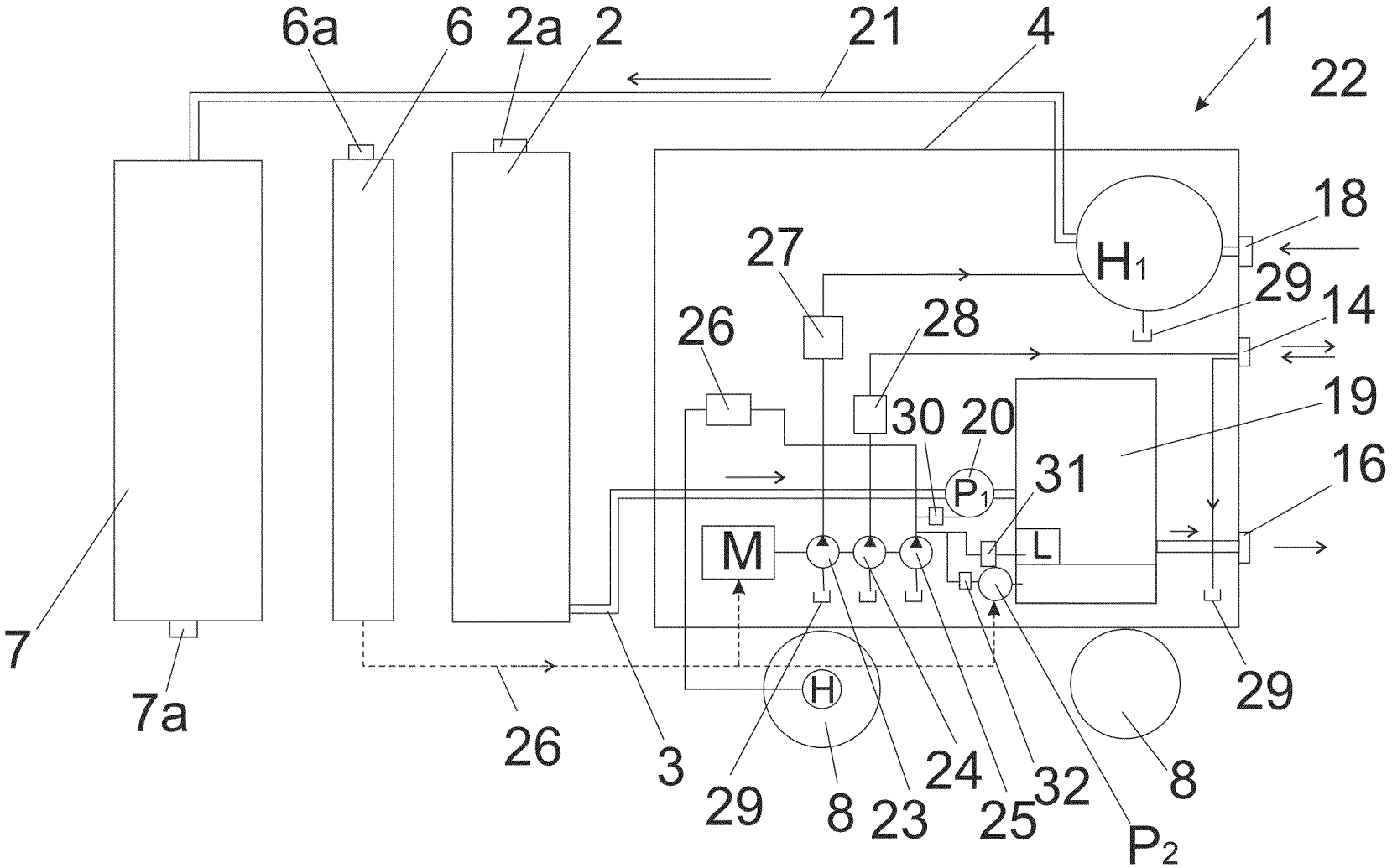
FIG. 2 shows a schematic diagram of one exemplary embodiment of a supply unit according to the invention.

FIG. 2 shows the supply unit 1 using one exemplary embodiment in greater detail, what is known as the "power module 4" with its interior construction being shown diagrammatically in greater detail, above all. Otherwise, the same parts bear the same designations as in FIG. 1.

According to the invention, the supply unit 1 has a water tank 2 and a heating device 19 for heating water from the water tank 2. A water pump 20 in the water line 30 serves to convey water from the water tank 2 to the heating device 19.

The outlet of the heating device 19 is connected to a hot water and/or steam connector 16. In addition to hot water at nearly 100° C., superheated steam at higher temperatures (for example, between 130° C. and 180° C.) can also be provided.

Furthermore, a dirty water tank 7 is provided. Said dirty water tank is connected via a dirty water line 21 to a suction device 22 which serves to extract dirty water from a cleaning machine via a flexible hose which can be connected to the dirty water connector 18, and ultimately to move it into the dirty water tank 7.

A (central) drive is provided in order to drive the different components of the supply unit 1 and/or the cleaning machine which can be connected in accordance with part A of FIG. 1, which (central) drive has substantially a diesel internal combustion engine M and, in the example which is shown, three hydraulic pumps 23, 24 and 25.

The fuel tank 6 for the internal combustion engine M is part of the supply unit, it being possible for the latter to operate autonomously. That is to say, it does not require any further energy supply from the outside, for example via a power cable. Conversely, the supply unit can use the energy which is ultimately obtained from the fuel to form hot water or steam for driving components, whether in the supply unit itself or in the cleaning machine which is connected to it (such as the brushes in accordance with the cleaning machine of part A of FIG. 1 and FIG. 3).

As FIG. 1 has already shown, the tanks are of cuboid configuration and are shown separately in FIG. 2 merely for reasons of improved illustration. In reality, they are lined up virtually wall-to-wall on one another as in FIG. 1, closely next to what is known as the "power module 4."

The supply unit 1 has wheels 8, of which the rear wheels are driven via a hydraulic motor H. The hydraulic pump 25 is provided in order to drive the rear wheels via the hydraulic motor H, from which hydraulic pump 25 a line leads via a regulating valve 26 to the hydraulic motor.

The control lines for the regulating valve 26 and also the other valves are not shown for the sake of clarity. An electronic control unit (likewise not shown) is provided which can be arranged either in the supply unit or externally. It is ultimately a question of controlling the valves via electric control signals. Manual control of the valves is in principle also conceivable and possible.

The drive is otherwise configured in such a way that, in the case of a closed valve 26, a braking function in the sense of a handbrake is achieved. That is to say, the supply unit is held even in the case of steep locations, without an additional brake being required.

Whereas that embodiment of the supply unit according to the invention which is shown in FIGS. 1 and 2 is of self-propelling configuration, a construction which is not self-propelling is also conceivable and possible. It is then loaded as a structural unit onto the loading area or the chassis of the vehicle, in particular of a truck for municipal purposes.

The diesel engine M has an electric starter (not shown) and receives the fuel via the diesel line 26. Its engine power output can be regulated via a regulating device (not shown).

In addition to the above-described hydraulic pump 25 for the propulsion drive of the supply unit, the diesel engine M also drives two further hydraulic pumps 23 and 24 which can be seated on a common shaft.

The hydraulic pump 23 serves via a control valve 27 to drive the hydraulic fan motor H1 of the suction device 22.

The hydraulic pump 24 serves to supply the external cleaning machine via the hydraulic connector 14. Regulation can take place via the valve 28. It is to be mentioned at this point that the oil reservoir is not shown for reasons of clarity. It is indicated diagrammatically by way of a horizontal U with the designation 29.

The hydraulic pump 25 serves not only to drive the wheels 8, but rather also for three further "consumers." These are as follows:

A water pump 20 with a hydraulic motor, which water pump 20 can be actuated via a valve 30.

Furthermore, a fan L of the heating device 19 can be actuated via a valve 31. The fan L is also hydraulically driven.

Finally, a pump P2 is also provided which is driven by a valve 32. Said pump P2 serves to convey fuel from the fuel tank 6 to the burner (not shown in greater detail) of the heating device 19.

It can be seen from the above text that the term "hydraulic motor" can be interpreted very broadly. It also includes pumps which are driven with hydraulic fluid.

In comparison with an electric drive which is also conceivable, the hydraulic drive has the advantage of a small overall size and a lower weight. Very powerful components with a high performance can also be controlled simply.

Figure 3:
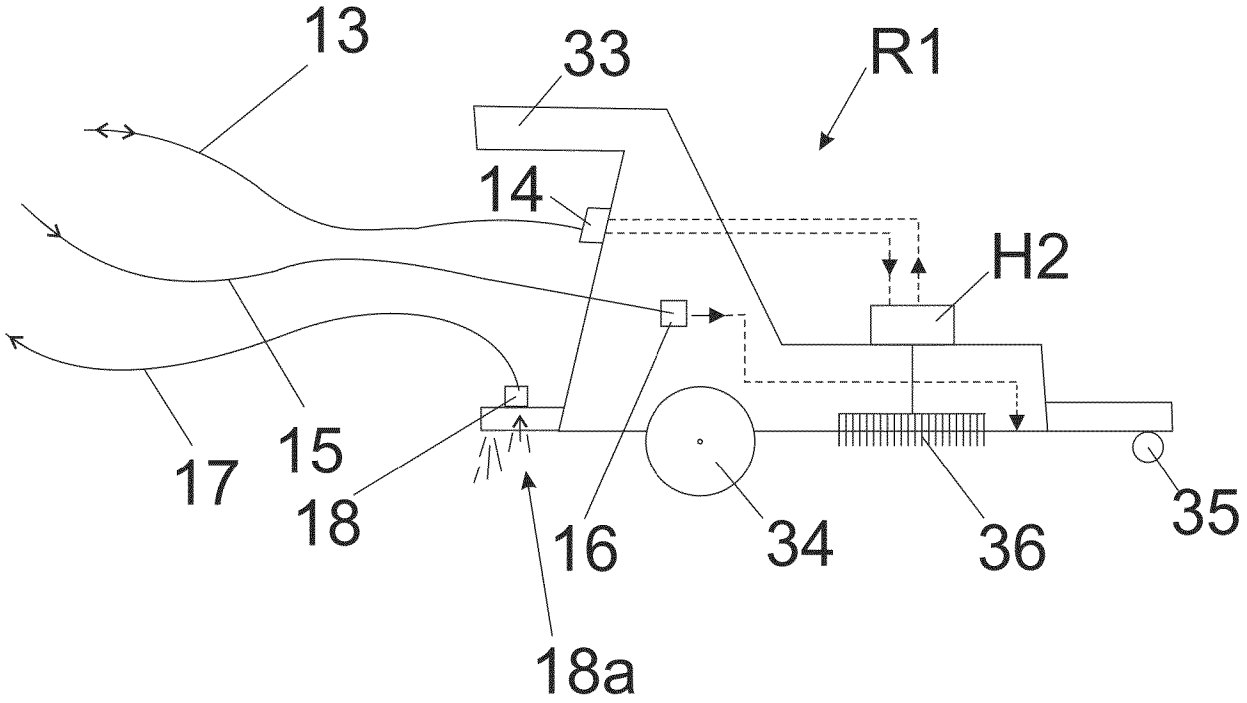
FIG. 3 shows a diagrammatic illustration of one exemplary embodiment of a cleaning machine according to the invention which is similar to that of part A of FIG. 1.

FIG. 3 shows one exemplary embodiment of a handheld cleaning machine R1, as is also shown similarly in part A of FIG. 1.

The handheld cleaning machine R1 has a handle 33 with possible operating elements (not shown), and a main wheel pair 34 and support wheels 35.

Furthermore, the handheld cleaning machine in accordance with FIG. 3 has a connector 14, via which a flexible hydraulic line can be connected. Via said hydraulic line, the hydraulic motor H2 can be driven, which hydraulic motor H2 for its part drives a cleaning brush 36 or a plurality of coupled brushes.

The rotational direction of the cleaning brush 36 or, in the case of a plurality of pumps, the rotational direction of one, a plurality of or all brushes can be changed by the operator. It is also possible that an electronic control unit changes the rotational direction of the brushes automatically at predefined time intervals.

In the case of a hydraulic motor, a suitable valve combination can be provided in order to reverse the rotational direction, which valve combination simply loads the hydraulic motor on different lines and with pressurized hydraulic oil in the case of a reversed rotational direction.

In the case of a possible electric motor, the reversal of the rotational direction can take place by way of electric actuation.

The rotational speed of the brushes is preferably between 50 and 90 revolutions per minute, very preferably in the order of magnitude of 70 revolutions per minute. It has been shown that, in said rotational speed range, above all in the outdoor region on streets or sidewalks, an excellent removal of contaminants which adhere on the ground, in particular of chewing gum residues, is possible.

The steam or the hot water can then be applied at a suitable location to the surface to be cleaned. The steam from the boiler, the boiler temperature of which is 170° C., for example, expands in the region of the work implement before coming into contact with the ground at a temperature of preferably between 90° C. and 120° C., preferably between 92° C. and 110° C. It has been shown that an excellent removal of chewing gum residues is once again possible in said temperature range.

Finally, the cleaning machine in accordance with FIG. 3 has a connector 18 for a flexible hose 17 for extraction from an extraction region 18*a* of the cleaning machine R1.

Figure 4:
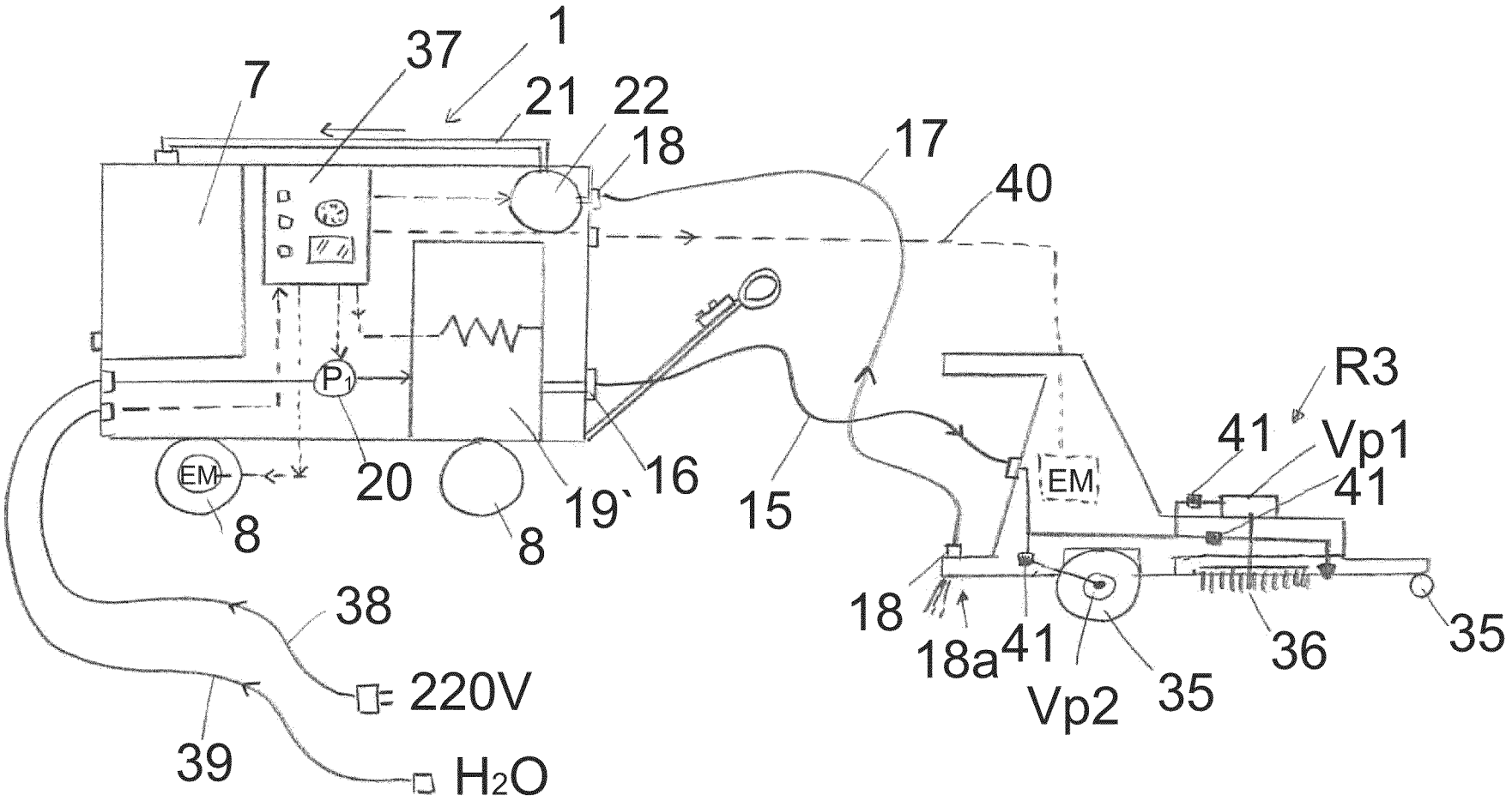
FIG. 4 shows a diagrammatic illustration of an exemplary embodiment of supply units and a cleaning machine with an electric primary supply, an external water supply and a steam drive.

The exemplary embodiment which is shown in FIG. 4 is an alternative to the variants which are shown in the preceding figures. The essential differences are: external water supply, external current supply as a primary energy source, and electric drive and/or steam drive of the movable components. In this respect, in detail:

Current can be fed externally to the supply unit via a current cable 38. A specified voltage of 115 V, or a voltage specification 220 V, are understood to represent examples only. Other voltages are of course also conceivable and possible. Moreover, the cable is shown merely diagrammatically. It can also be rolled up or guided in some other way.

In any case, the current then passes into the central electric control and/or regulating unit 37 which is provided with diagrammatically shown operating elements and displays. From there, the current then passes to different components: for one thing to the electric motor EM for the wheel drive of the wheels 8; moreover, to the pump P1 which feeds externally fed water (line 39) to the heating device 19'. Said heating device 19' is operated electrically. The heating coil is shown diagrammatically. The heating device 19' serves to heat the externally fed water, to be precise to a temperature, at which there is pressurized steam which is then available at the connector 16. Said pressurized steam 16 can then be fed via the line 15 to the cleaning machine R3 which then has steam engines VP1 and VP2 instead of the hydraulic motors which are shown in FIGS. 1 and 3. The control lines are not shown for the sake of clarity; they can be lines with a galvanic contact, but radio connections are also conceivable and possible. The point of origin of the controller can be either the central control unit 37 in the supply unit, or else control and operating levers on the cleaning machine R3 itself.

As an alternative or in addition to the steam drive which is shown in FIG. 4, the cleaning machine R3 can also have an electric drive with a motor EM which is fed via an electric line 40. The motor EM is shown diagrammatically. It can drive the brush 36 or the wheels 35 via suitable mechanical connections. It is also possible, however, that two or more electric motors are provided (in a similar manner to that in the case of the steam engines VP1 and VP2).

Overall, in the case of the invention, both hydraulic drives (as in FIG. 1, part A, and FIGS. 2, 3) and drives using steam or electric drives (as in FIG. 4) or mixtures thereof can thus be provided in order to drive the movable components.

The invention also relates, in particular, to the use of a supply unit or a cleaning machine for the removal of contaminants on surfaces which lie in the outdoor region, in particular streets and/or sidewalks. In this way, it is possible, above all, to remove dirt residues in an excellent manner, in particular chewing gum residues.

The invention claimed is:

1. A cleaning machine, comprising a supply unit, the supply unit comprising:

at least one flexible hose;

a heating device for boiling water, said heating device having an outlet;

a water pump for conveying water into or out of said heating device;

a hot water and/or steam connector in communication with said outlet of said heating device;

a dirty water tank; and a suction device for sucking dirty water from a dirty water connector into said dirty water tank, wherein the at least one flexible hose conveys fluid which drives at least one motor.

2. The supply unit according to claim 1, which further comprises a water tank for feeding water to said heating device.

3. The supply unit according to claim 2, wherein one or more of said water tank, said dirty water tank or a fuel tank is formed as a substantially cuboid hollow body.

4. The supply unit according to claim 1, which further comprises dedicated wheels that are at least partially driven and enabling the supply unit to be moved thereon.

5. The supply unit according to claim 1, which comprises a support frame and wherein at least the following components are combined via said support frame to form a structural unit:

said heating device including said water pump;

said suction device;

a motor; and at least one hydraulic pump which is driven by said motor.

6. The supply unit according to claim 5, wherein said support frame is constructed from a plurality of supports which surround an interior space for receiving the components.

7. The cleaning machine according to claim 1, comprising a connector for the flexible hose for feeding steam or hot water, wherein a temperature of the steam is set to lie between 90° C. and 120° C. in the region of the floor to be cleaned.

8. The cleaning machine according to claim 1, wherein said cleaning machine has a connector for the flexible hose for extraction from an extraction region of the cleaning machine.

9. The cleaning machine according to claim 1, the at least one motor including at least one of brushes or drive wheels, and said cleaning machine further comprising a connector for the flexible hose for supplying energy from the supply unit to said at least one motor.

10. The cleaning machine according to claim 9, wherein the at least one motor is a hydraulic motor, and said flexible hose is a hydraulic line.

11. The cleaning machine according to claim 9, wherein the at least one motor is an electric motor, and said flexible hose is a bipolar or multipolar electric line.

12. The cleaning machine according to claim 9, wherein the at least one motor is a steam engine, and said flexible hose is a steam hose for conducting pressurized steam.

* * * * *